US007007431B2

(12) United States Patent
Schubert

(10) Patent No.: US 7,007,431 B2
(45) Date of Patent: Mar. 7, 2006

(54) MULTI-STORY BUILDING AND METHOD FOR CONSTRUCTION THEREOF

(75) Inventor: Fred E. Schubert, Knoxville, TN (US)

(73) Assignee: NCI Building Systems, LP, Houston, TX (US)

( * ) Notice: Subject to any disclaimer, the term of this patent is extended or adjusted under 35 U.S.C. 154(b) by 0 days.

(21) Appl. No.: 10/435,303

(22) Filed: May 9, 2003

(65) Prior Publication Data

US 2004/0221521 A1 Nov. 11, 2004

(51) Int. Cl.
*E04B 1/00* (2006.01)

(52) U.S. Cl. ..... 52/263

(58) Field of Classification Search ..... 52/263, 52/726.3, 236.3, 252, 264; 403/170, 175, 403/174, 178, 173
See application file for complete search history.

(56) References Cited

U.S. PATENT DOCUMENTS

| | | | | | |
|---|---|---|---|---|---|
| 7,412 | A | | 6/1850 | Fisher | |
| 992,739 | A | * | 5/1911 | Meier | 52/252 |
| 3,017,723 | A | | 1/1962 | Heidenstam | |
| 3,254,466 | A | | 6/1966 | Von Heidenstam | |
| 3,260,028 | A | | 7/1966 | Fraser | |
| 3,355,853 | A | | 12/1967 | Wallace | |
| 3,713,265 | A | | 1/1973 | Wysocki et al. | |
| 3,793,794 | A | | 2/1974 | Archer et al. | |
| 3,978,630 | A | | 9/1976 | Labie et al. | |
| 4,173,853 | A | | 11/1979 | Logan | |
| 4,272,929 | A | | 6/1981 | Hanson | |
| 4,346,540 | A | | 8/1982 | Anderson | |
| 4,630,417 | A | * | 12/1986 | Collier | 52/263 |
| 5,123,220 | A | * | 6/1992 | Simenoff | 52/252 |
| 5,182,884 | A | | 2/1993 | Tarics | |
| 5,289,665 | A | * | 3/1994 | Higgins | 52/655.1 |
| 5,320,439 | A | | 6/1994 | Perrault et al. | |
| 5,412,913 | A | * | 5/1995 | Daniels et al. | 52/79.13 |
| 5,687,537 | A | | 11/1997 | Noble | |
| 6,141,927 | A | * | 11/2000 | Usui | 52/263 |
| 6,151,851 | A | | 11/2000 | Carter | |
| 2004/0074176 | A1 | * | 4/2004 | Baker | 52/263 |

* cited by examiner

*Primary Examiner*—A. Joseph Wujciak
(74) *Attorney, Agent, or Firm*—Gardere Wynne Sewell LLP

(57) ABSTRACT

A method, apparatus and system for constructing a building. A foundation is provided, upon which is disposed one or more first-floor columns, each having a lower end, an upper end and an upper surface. One or more second-floor columns, each having a lower end, an upper end, a lower surface and an upper surface on one or more of the first-floor columns, are disposed on the top of the first-floor columns so that the lower surface of one or more of the second-floor columns abuts, and is supported by, the upper surface of one or more of the first-floor columns.

7 Claims, 14 Drawing Sheets

MULTI-STORY BUILDING AND METHOD FOR CONSTRUCTION THEREOF

FIELD OF THE INVENTION

The present invention relates to methods of building construction, and specifically to a method of constructing a multi-story building, and in particular to a method of building construction using columns constructed from modular column segments.

BACKGROUND OF THE INVENTION

Multistory steel-framed buildings have conventionally been constructed using vertical steel columns spanning the full height of the building from the bottom floor to the roof. Each column is often provided in one piece for buildings with only a few stories. For buildings with more than a few stories, each column is commonly constructed from multiple column members, each spanning several floors. After placement of the columns, floors are then framed with horizontal beams attached to the columns by fin plates or welding, and joists and floor decking are installed on the horizontal beams.

In prior designs, the vertical columns can be relatively tall. In some cases, columns may extend 30 to 50 feet or more for a structure having only a few floors. Because the columns are so tall, they are necessarily very heavy. A steel column for a typical three-story building may have a weight in the range of about 700 to 1,200 pounds. As a result, heavy-duty lifting equipment is generally required to place the columns in position. Cranes must often be stationed on the construction site, which adds significant cost and potential coordination difficulties to the project.

SUMMARY OF THE INVENTION

In one embodiment, the present invention is a method of constructing a building comprising the steps of providing a foundation; disposing one or more first-floor columns, each having a lower end, an upper end and an upper surface, on the foundation; and disposing one or more second-floor columns, each having a lower end, an upper end, a lower surface and an upper surface on one or more of the first-floor columns, so that the lower surface of one or more of the second-floor columns abuts, and is supported by, the upper surface of one or more of the first-floor columns.

In a second embodiment, the present invention is a building comprising a foundation; one or more first-floor columns, each having a lower end, an upper end and an upper surface, disposed on the foundation; and one or more second-floor columns, each having a lower end, an upper end, a lower surface and an upper surface disposed on one or more of the first-floor columns, so that the lower surface of one or more of the second-floor columns abuts and is supported by the upper surface of one or more of the first-floor columns.

In a third embodiment, the present invention is a system for constructing a building comprising at least one first-floor column having an upper end and a lower end, the lower end having at least one mounting flange attached thereto and the upper end having an internal receiving aperture and one or more mounting ears attached to the outside thereof. The system incorporates at least one second-floor support beam having features shaped and sized to facilitate securement to a mounting flange of a first-floor column and at least one internal connector having a first portion having an external cross-sectional profile matching the internal receiving aperture of the first-floor column and a second portion having an external cross-sectional profile. The system also makes use of at least one second-floor column having an upper end and a lower end, the lower end having an internal receiving aperture having an internal cross-sectional profile matching the external cross-sectional profile of the second portion of the internal connector.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENTS

Figure 1A:
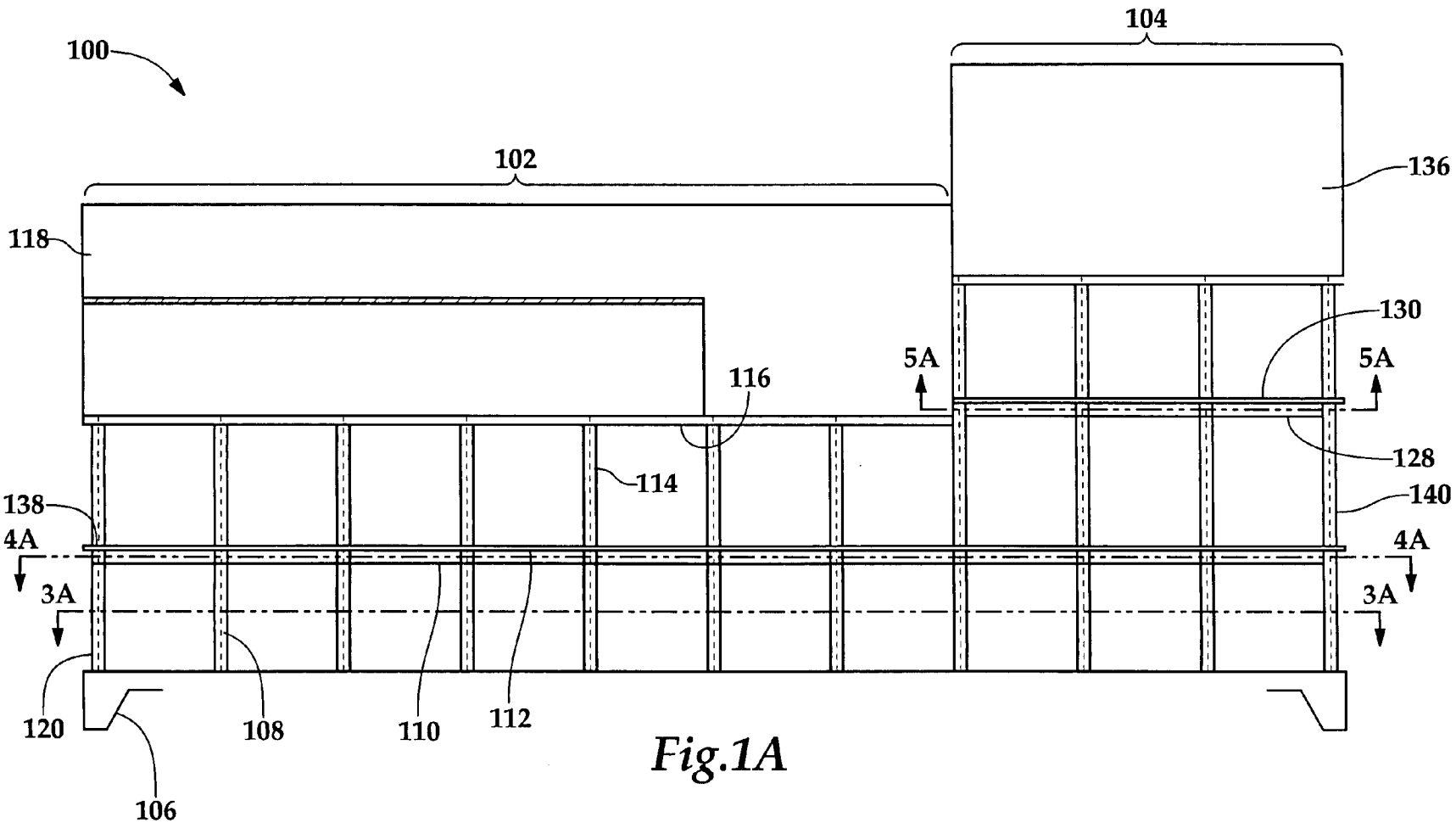
FIG. 1A is a side partial section view taken generally along line 1A—1A of FIG. 2A of a building in accordance with a first embodiment of the present invention.
Figure 1B:
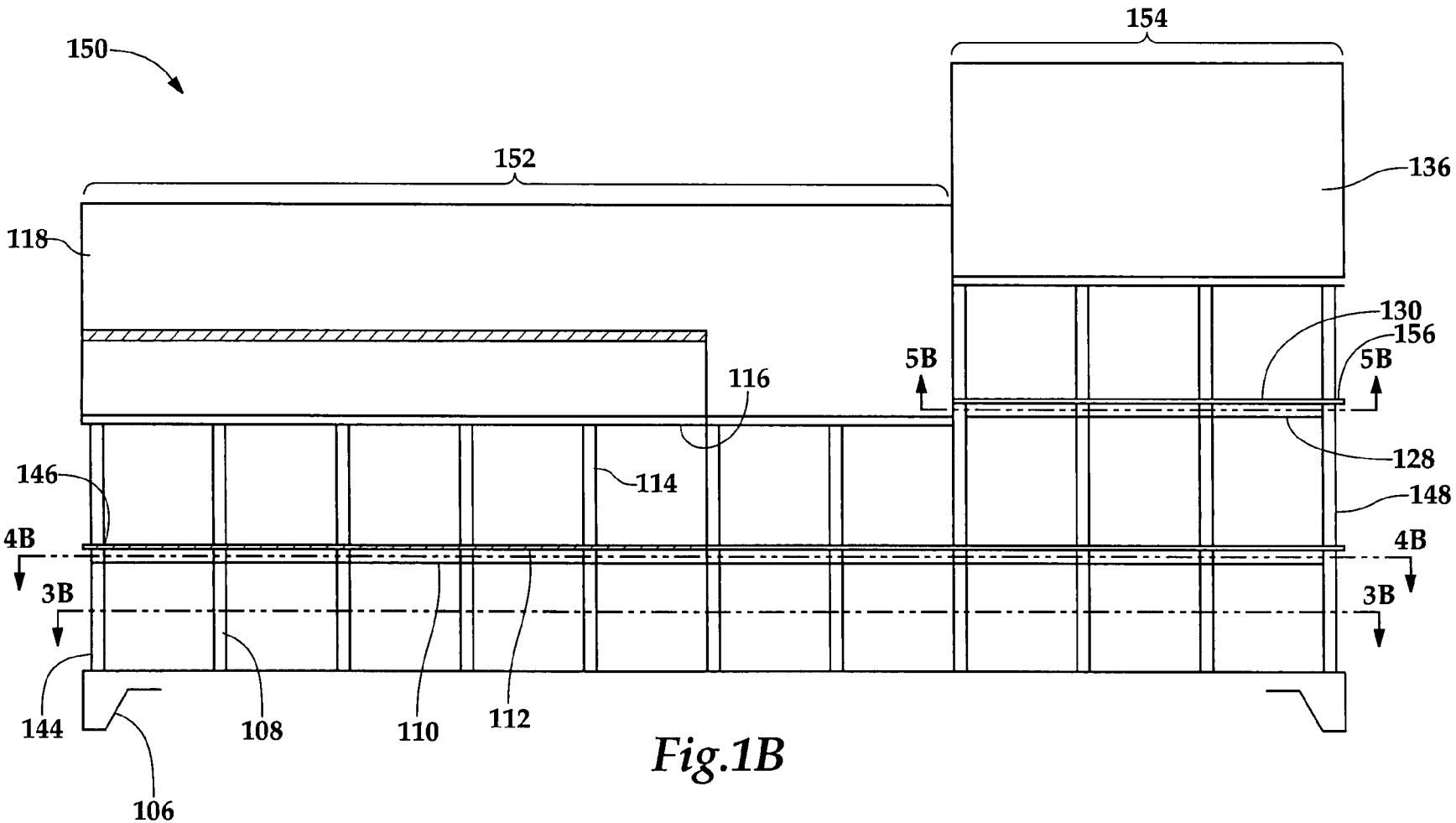
FIG. 1B is a side partial section view taken generally along line 1B—1B of FIG. 2B of a building in accordance with a second embodiment of the present invention.

FIGS. 1A–5A depict a building 100 according to a first embodiment of the present invention. Building 100 includes a first portion 102 and a second portion 104, built on a common foundation 106. Foundation 106 shown is a concrete load-bearing foundation, but other foundation types may be employed without departing from the present invention.

Building 100 is constructed from a set of first-floor columns 108 affixed to and supported by foundation 106. The support structure for the second floor 112, which includes set of beams 110, is supported by the upper ends of the first-floor columns 108. A set of second-floor columns 114 is also supported on the upper ends of the first-floor columns 108. The support structure for the roof 118, which includes a set of beams 116, is supported on the upper ends of second-floor columns 114.

Within second portion 104, a third floor is included. The support structure for the third floor 130, which includes a set of third-floor beams 128, is supported by the upper ends of second-floor columns 114. Second portion 104 also includes a roof 136.

Figure 3A:
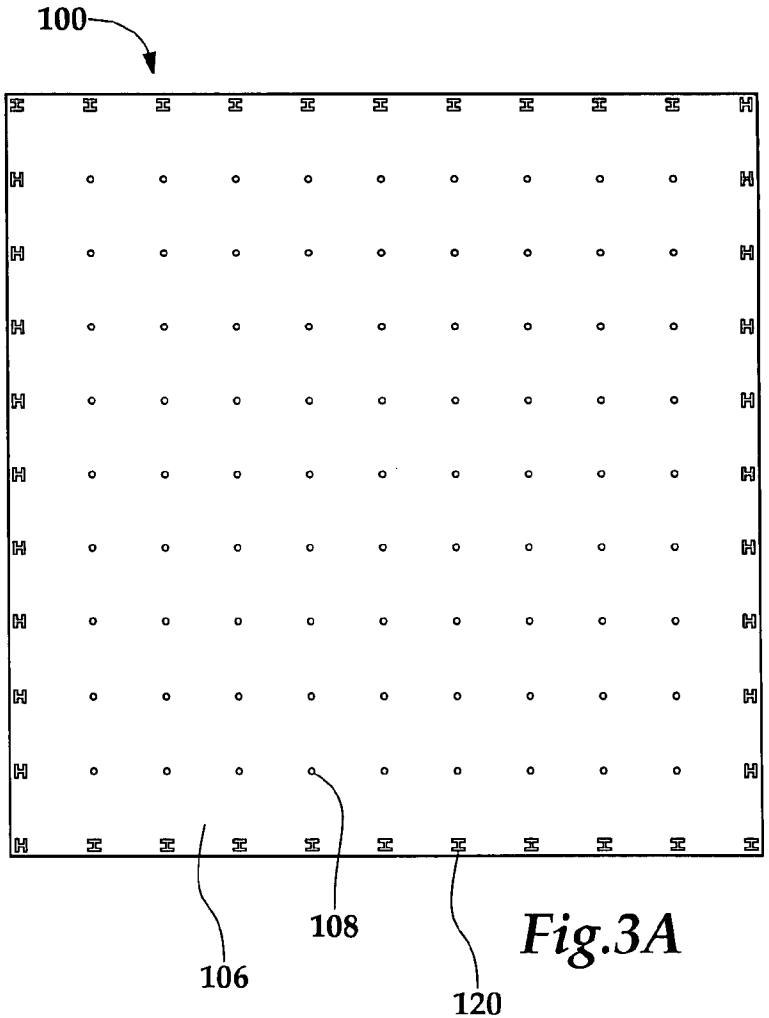
FIG. 3A is a section view taken along line 3A—3A of the building of FIG. 1A.
Figure 2A:
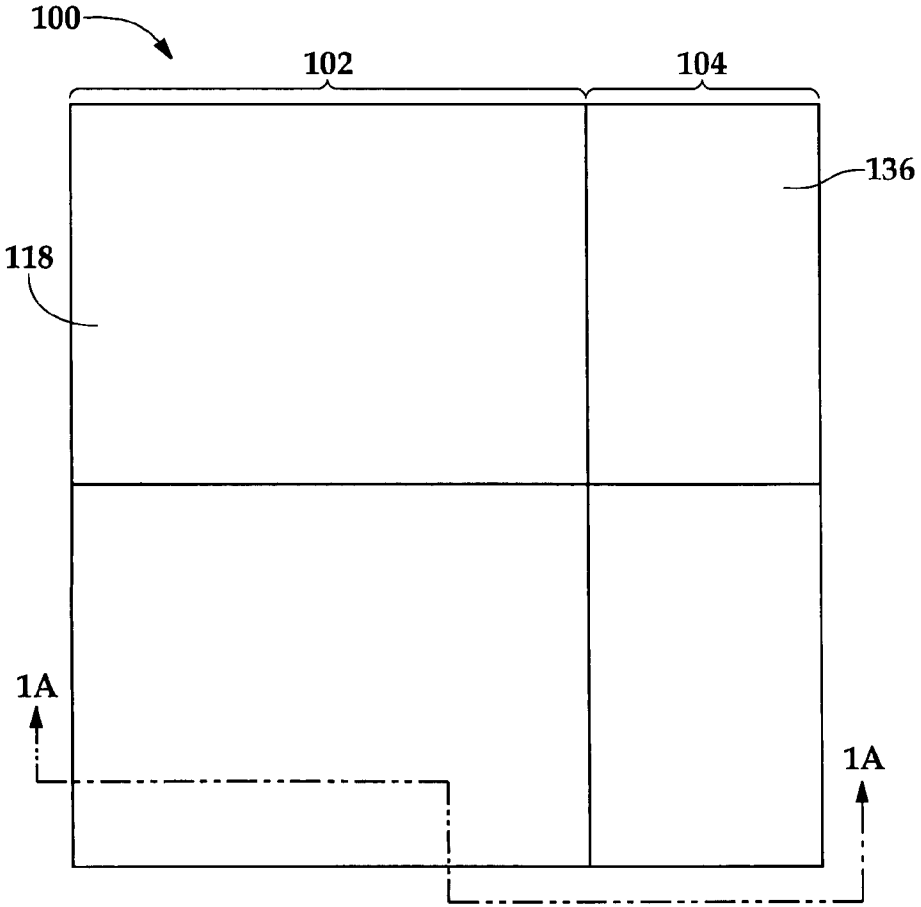
FIG. 2A is a top view of the building of FIG. 1A.
Figure 4A:
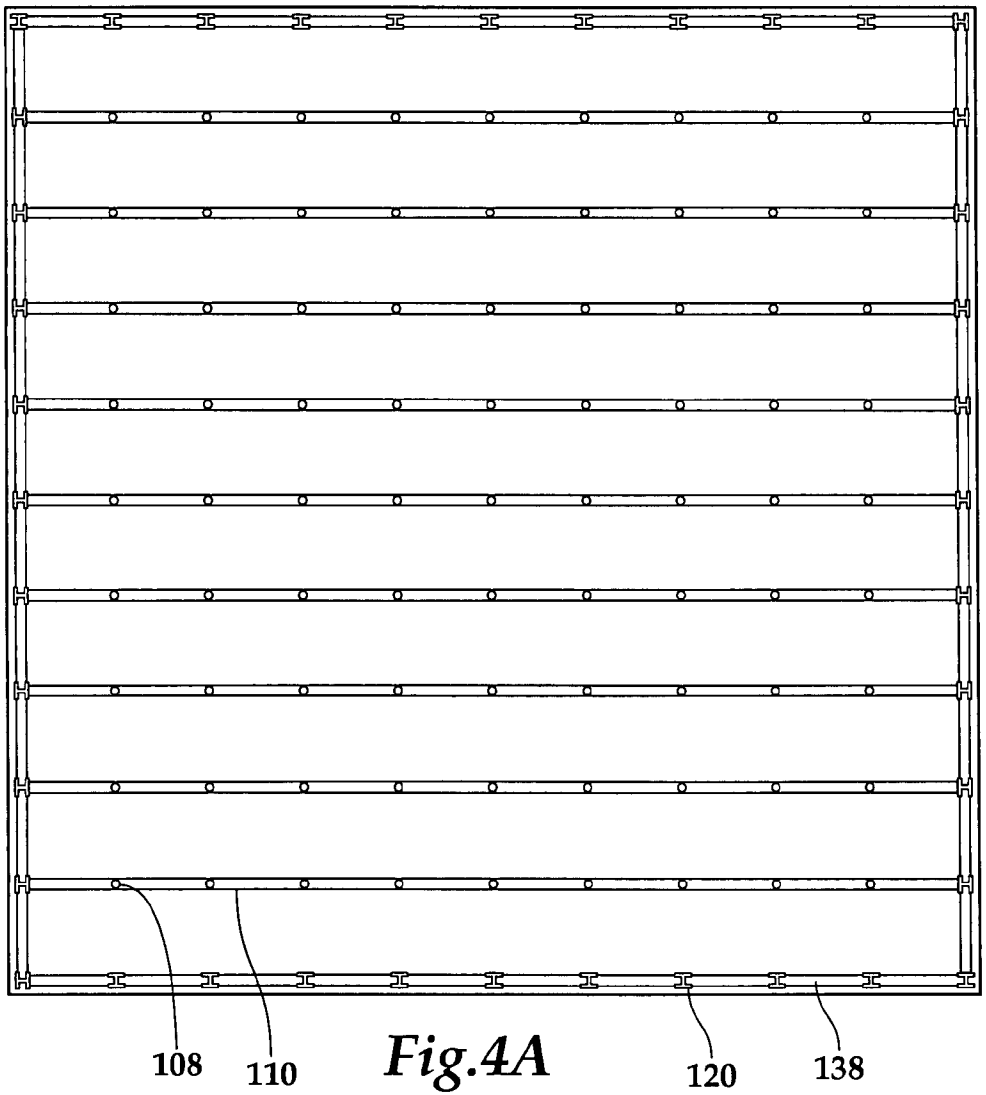
FIG. 4A is a section view taken along line 4A—4A of the building of FIG. 1A.
Figure 3B:
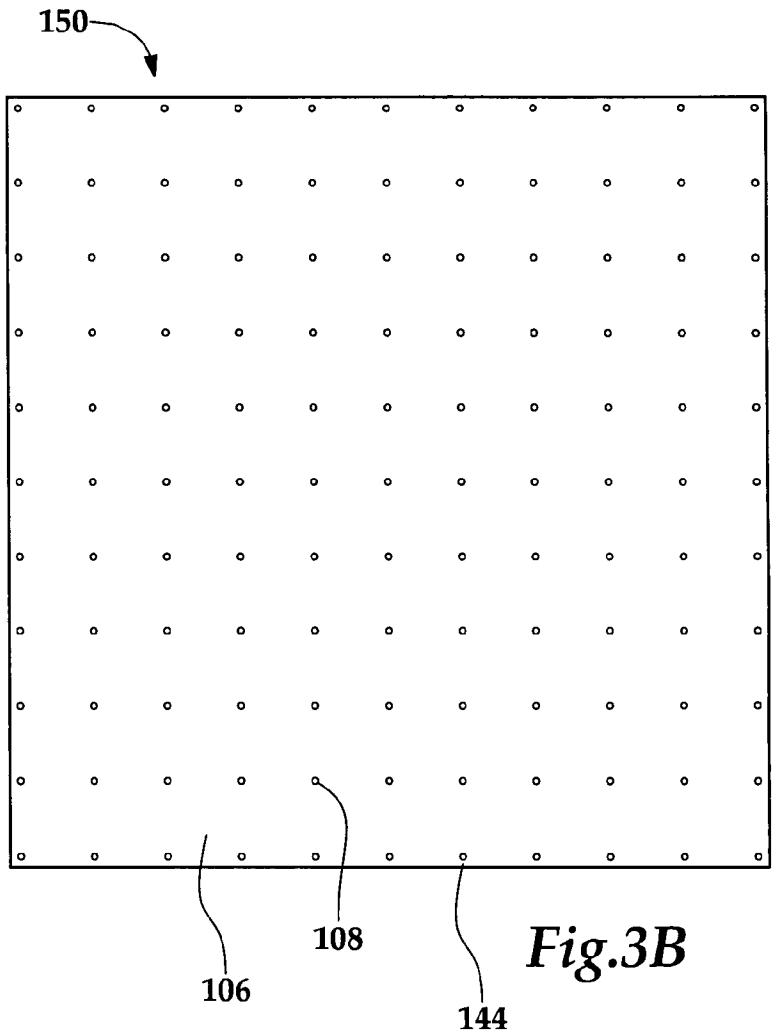
FIG. 3B is a section view taken along line 3B—3B of the building of FIG. 1B.
Figure 2B:
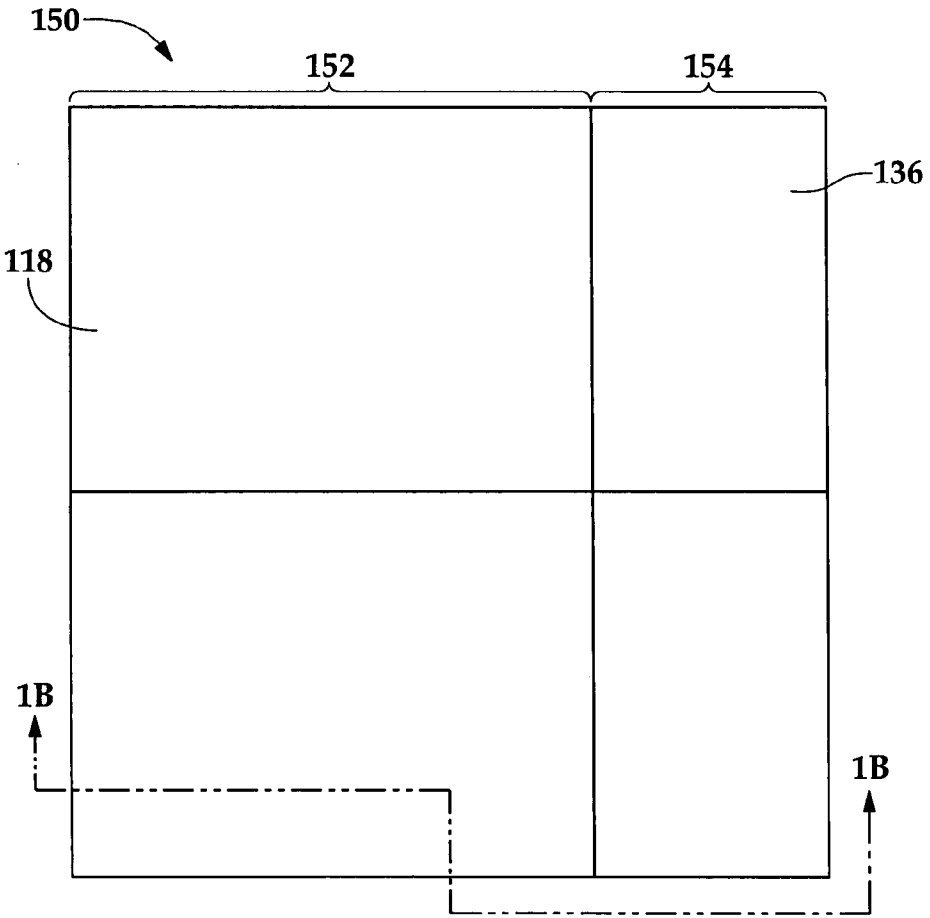
FIG. 2B is a top view of the building of FIG. 1B.
Figure 4B:
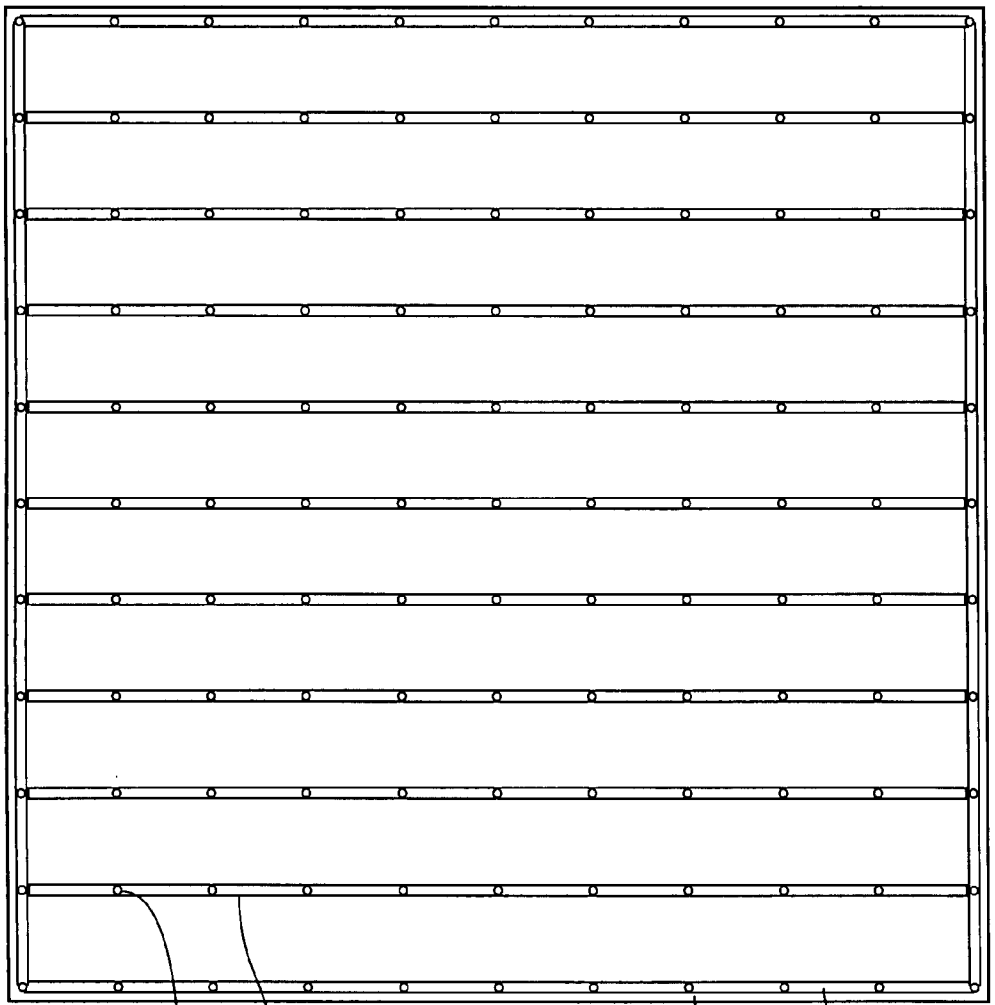
FIG. 4B is a section view taken along line 4B—4B of the building of FIG. 1B.

As shown clearly in FIGS. 3A, 4A, and 4B, the structure of building 100 includes a set of perimeter columns 120 in addition to the interior columns 108 described above. In the embodiment shown in FIGS. 1A, 3A, and 4A, perimeter columns 120 are shown as having a wide flange or I-beam profile, while interior first-floor columns 108 are shown as having a cylindrical profile. There is nothing within the invention necessarily limiting the construction method or layout to this particular arrangement. Similarly, interior second-floor beams 110 and perimeter second-floor beams 138 may be, as an example, wide flange beams, but there is nothing within the spirit and scope of the present invention limiting these structural members to this type of beam. It is not necessary that interior second floor beams 110 and perimeter second floor beams 138 be of the same type. The only requirement for these structural members is that they be of sufficient strength to withstand the load demands placed on them by the weight of building 100 and any external forces acting thereon.

Figure 5A:
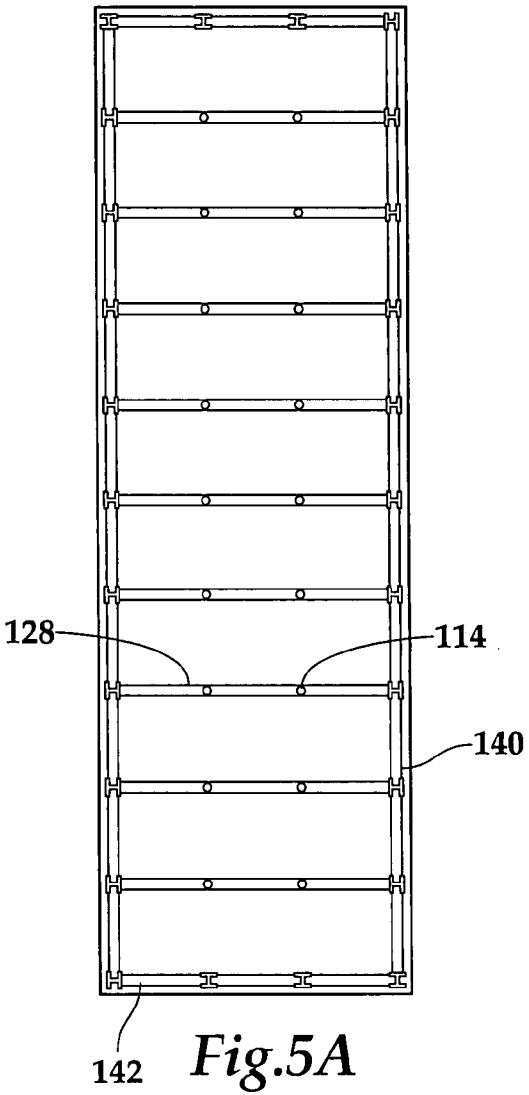
FIG. 5A is a section view taken along line 5A—5A of the building of FIG. 1A.

The layout of various structural components incorporated into the third floor 130 is shown in FIG. 5A. An array of second floor columns 114 supports a grid of third floor beams 128, while a ring of perimeter columns 140 supports a set of perimeter beams 142. In the embodiment shown in FIG. 5A, perimeter columns 140 are shown as having a wide flange or I-beam profile, while interior second-floor columns 114 are shown as having a cylindrical profile. There is nothing within the invention necessarily limiting the construction method or layout to this particular arrangement. Similarly, interior third-floor beams 128 and perimeter third-floor beams 142 may be, as an example, wide flange beams, but there is nothing within the spirit and scope of the present invention limiting these structural members to this type of beam. It is not necessary that interior third floor beams 128 and perimeter third floor beams 142 be of the same type. The only requirement for these structural members is that they be of sufficient strength to withstand the load demands placed on them by the weight of building 100 and any external forces acting thereon.

FIGS. 1B, 2B, 3B, and 5B depict a building 150 according to a second embodiment of the present invention. Building 150 includes a first portion 152 and a second portion 154, built on a common foundation 106. Foundation 106 shown is a concrete load-bearing foundation, but other foundation types may be employed without departing from the present invention.

Building 150 is constructed from a set of first-floor columns 108 affixed to and supported by foundation 106. The support structure for the second floor 112, which includes set of beams 110, is supported by the upper ends of the first-floor columns 108. A set of second-floor columns 114 is also supported on the upper ends of the first-floor columns 108. The support structure for the roof 118, which includes a set of beams 116, is supported on the upper ends of second-floor columns 114.

Within second portion 154, a third floor is included. The support structure for the third floor 130, which includes a set of third-floor beams 128, is supported by the upper ends of second-floor columns 114. Second portion 154 also includes a roof 136.

As shown clearly in FIGS. 3B–5B, the structure of building 150 includes a set of perimeter columns 144 in addition to the interior columns 108 described above. In the embodiment shown in FIGS. 1B–5B, perimeter columns 144 are shown as having a cylindrical profile, and interior first-floor columns 108 are shown as also having a cylindrical profile. There is nothing within the invention necessarily limiting the construction method or layout to this particular arrangement. As described above in connection with building 100, interior second-floor beams 110 and perimeter second-floor beams 138 may be, as an example, wide flange beams, but there is nothing within the spirit and scope of the present invention limiting these structural members to this type of beam. As noted above, it is not necessary that interior second floor beams 110 and perimeter second floor beams 138 be of the same type. The only requirement for these structural members is that they be of sufficient strength to withstand the load demands placed on them by the weight of building 150 and any external forces acting thereon.

Figure 5B:
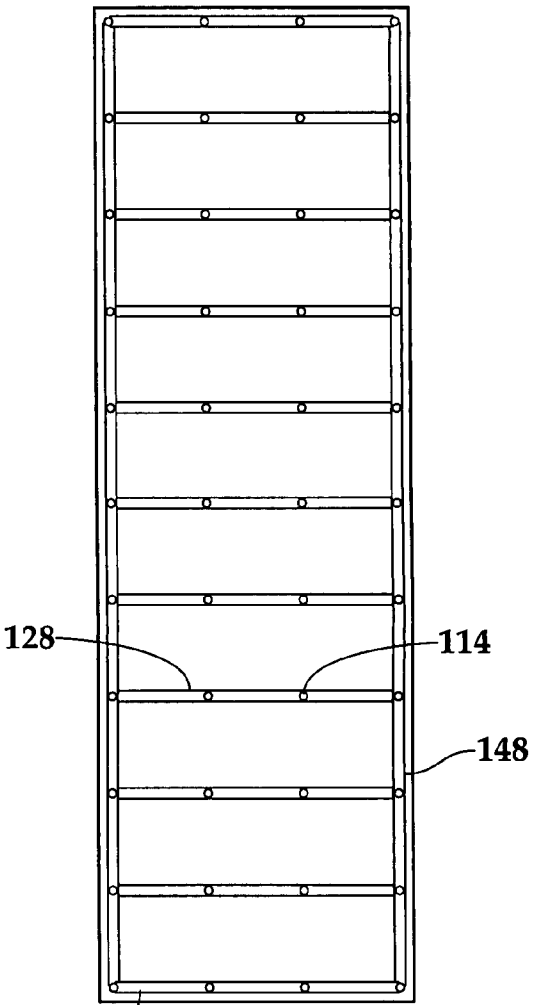
FIG. 5B is a section view taken along line 5B—5B of the building of FIG. 1B.

The layout of various structural components incorporated into the third floor 130 is shown in FIG. 5B. An array of second floor columns 114 supports a grid of third floor beams 128, while a ring of perimeter columns 148 supports a set of perimeter beams 156. In the embodiment shown in FIG. 5B, perimeter columns 148 are shown as having a cylindrical profile, and interior second-floor columns 114 are also shown as having a cylindrical profile. There is nothing within the invention necessarily limiting the construction method or layout to this particular arrangement. Similarly, interior third-floor beams 128 and perimeter third-floor beams 156 may be, as an example, wide flange beams, but there is nothing within the spirit and scope of the present invention limiting these structural members to this type of beam. It is not necessary that interior third floor beams 128 and perimeter third floor beams 156 be of the same type. The only requirement for these structural members is that they be of sufficient strength to withstand the load demands placed on them by the weight of building 150 and any external forces acting thereon.

FIGS. 6–13 show one embodiment of a building construction method suitable for employment in the construction of building 100 and other multi-story buildings. Construction of building 100 begins with a foundation 106. A set of first-floor columns 108 are affixed to and supported by foundation 106. In the embodiment shown in FIGS. 6–13, the bottom ends 202 of first-floor columns 108 are affixed to foundation 106 by fasteners 206 through a flange or mounting flange 204. Fasteners 206 may be any of a number of fastener types known to those of skill in the art, and may include, for example, threaded fasteners and driven fasteners. Flange 204 may, in turn, be affixed to the lower portion 202 of first-floor columns 108 by, for example, welding, adhesive, a threaded connection, by rivets or other fasteners, or by any other methods known to those of skill in the art of building construction.

Figure 7:
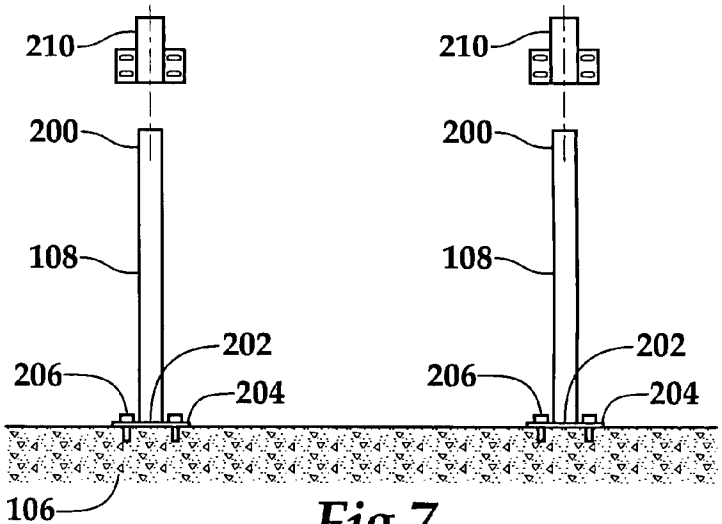
FIG. 7 is a side detail view of a building according to the present invention at a second stage of construction.
Figure 6:
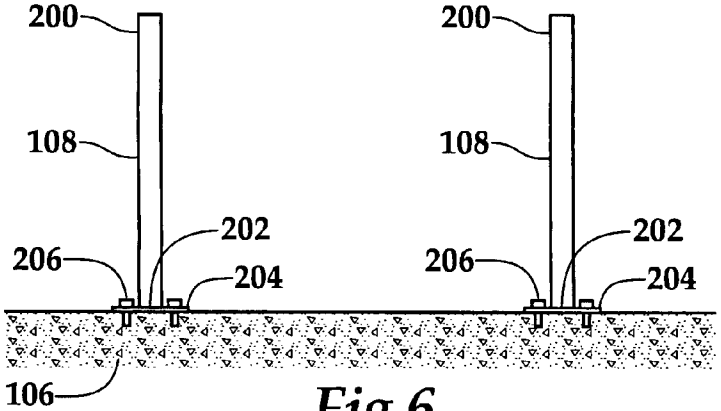
FIG. 6 is a side detail view of a building according to the present invention at a first stage of construction.

The upper portions 200 of first-floor columns 108 are sized and shaped to mate with the bottom end of connectors 210, which are slid down into place, as shown in FIG. 7. The specific cross-sectional shapes of first-floor columns 108 and connectors 210 are not critical to the present invention, so long as they are compatible and fit together. Connectors 210 may be sized to slide with respect to first-floor columns 108, or may be sized to have an interference fit with the mating surface. Connectors 210 may in certain embodiments be fastened in place with one or more threaded fasteners, rivets, weldments, braze joints or adhesives, as applicable.

Figure 9:
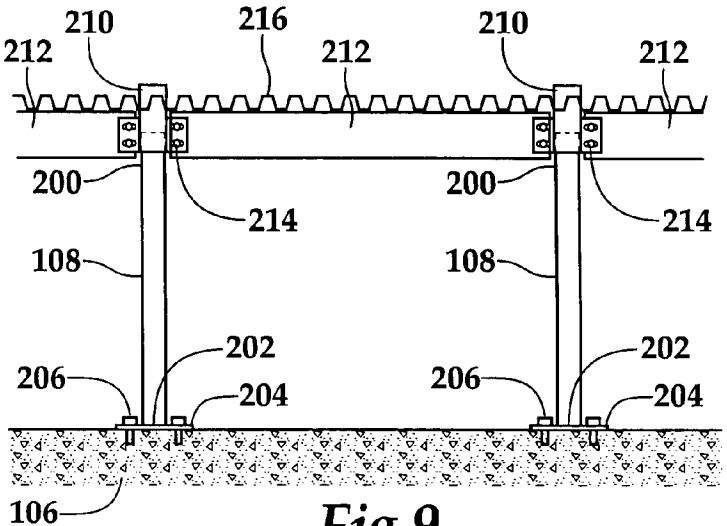
FIG. 9 is a side detail view of a building according to the present invention at a fourth stage of construction.
Figure 8:
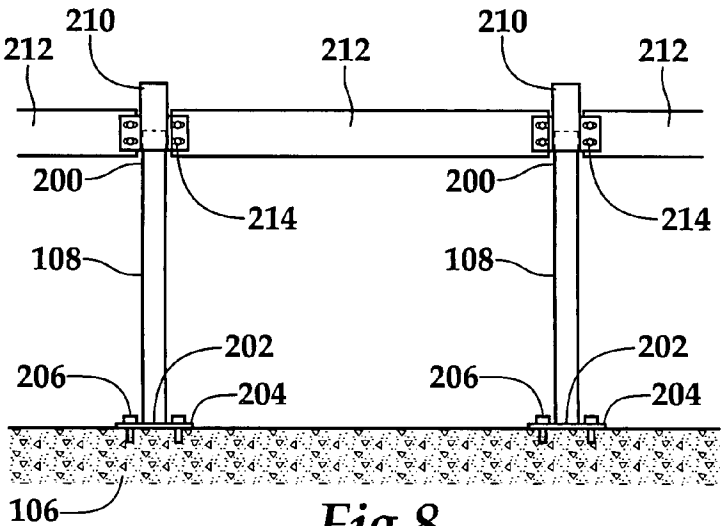
FIG. 8 is a side detail view of a building according to the present invention at a third stage of construction.

After placement of connectors 210, a set of second-floor beams 212 are assembled to connectors 210, as shown in FIG. 8. In the embodiment shown in FIGS. 6–3, the second-floor beams 212 are assembled to connectors 210 by fasteners 214, which may be threaded fasteners or rivets, as examples. After assembly of the second-floor beams 212 to the connectors 210, a sheet metal panel 216 is positioned in place over the top of the assembly of second-floor beams 212 and connectors 210, and moved past the tops of connectors 210 to rest on the tops of second-floor beams 212, as shown in FIG. 9.

The sheet metal panel 216 has a set of apertures (not shown) spaced appropriately therein so as to allow the tops of the connectors 210 to pass through the sheet metal panel 216 and to allow the bottom of the sheet metal panel 216 to come to rest on the top surfaces of the second-floor beams 212. In certain embodiments, sheet metal panel 216 may be fastened to the second-floor beams 212.

Figure 10:
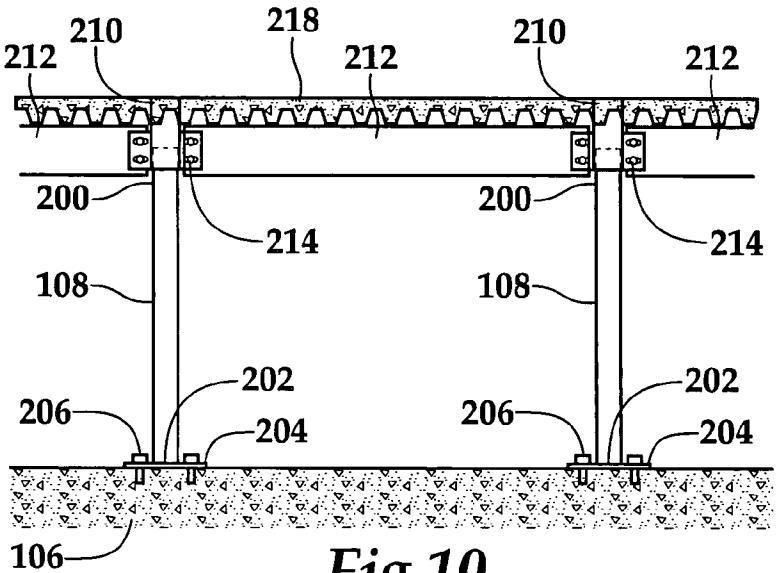
FIG. 10 is a side detail view of a building according to the present invention at a fifth stage of construction.

After placement of the sheet metal panel 216, a concrete slab 218 is poured on the top of the sheet metal panel 216, thereby forming second floor 112, as shown in FIG. 10. Concrete slab 218 is poured in such manner that the top surface of the concrete slab 218 is aligned to the tops of connectors 210. With this design, the tops of connectors 210 do not interfere with the pouring and preparation of concrete slab 218, while at the same time the tops of connectors 210 are left open so as to receive and interface with the upper structural members.

Figure 11:
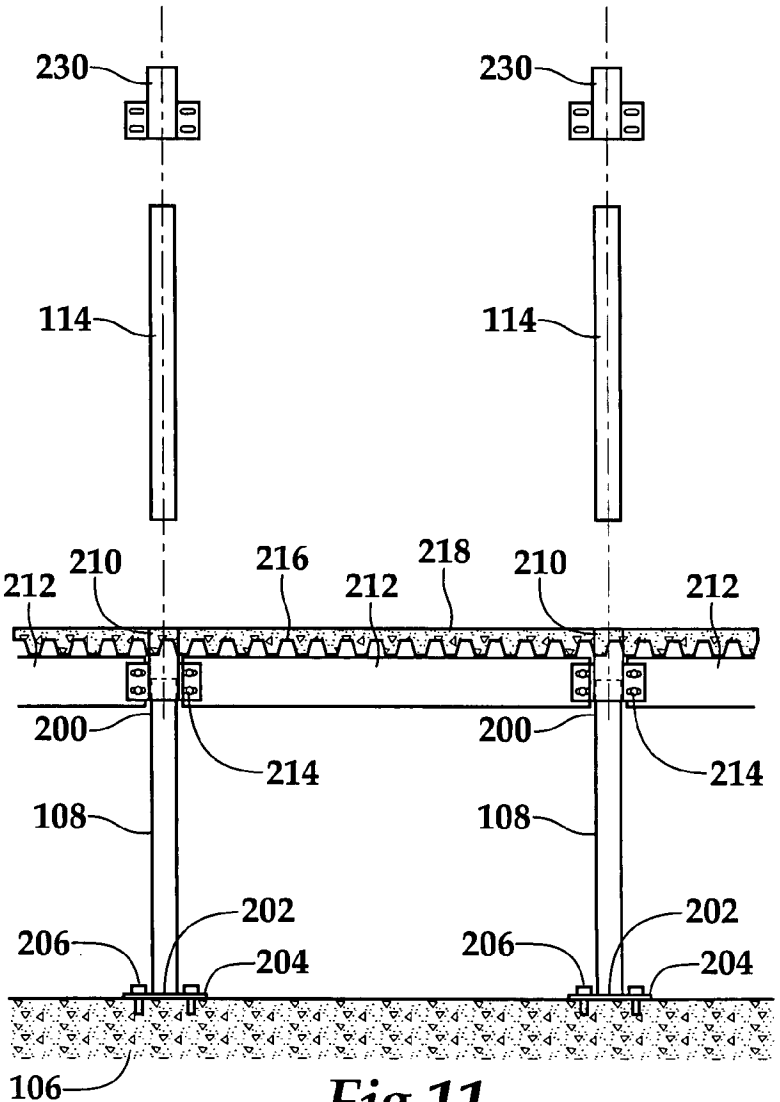
FIG. 11 is a side detail view of a building according to the present invention at a sixth stage of construction.

After curing of concrete slab 218, a set of second-floor columns 114 is inserted into the upper ends of connectors 210, as shown in FIG. 11. These second-floor columns 114 may be fastened, welded, brazed or adhered into place, as desired. Second floor columns 114 may be sized to freely slide into connectors 210, or may be sized for an interference fit.

In general, connectors 210 do not bear any weight loading from the upper floors of the building 100. The function of connectors 210 is to support the second floor 112 to which they are assembled and to align each of the second-floor columns 114 to the corresponding first-floor column 108. The vertical weight load from each second-floor column 114 is transferred directly from the bottom of the second-floor column 114 to the top of the first-floor column 108 directly beneath it.

In order to facilitate the transfer of vertical weight load from the second-floor columns 114 to the first-floor columns 114, it is desirable that the surface profile of the lower end of each of the second-floor columns 114 be shaped to register securely and conform to the surface profile of the upper end of each of the first-floor columns 108. In the simplest case, the two mating profiles may be planar and normal to the principal axis of the columns. In alternate embodiments, the first-floor columns 108 and second-floor columns 114 may interface through a conic surface profile, a spherical surface profile, a parabolic surface profile or any other surface profile, so long as there is sufficient contact area between the lower end of the second-floor column 114 and the upper end of the first-floor column 108 to support the required weight load without failure. In certain embodiments, a certain degree of material deformation may be designed in, so as to facilitate full engagement between the two columns.

Figure 13:
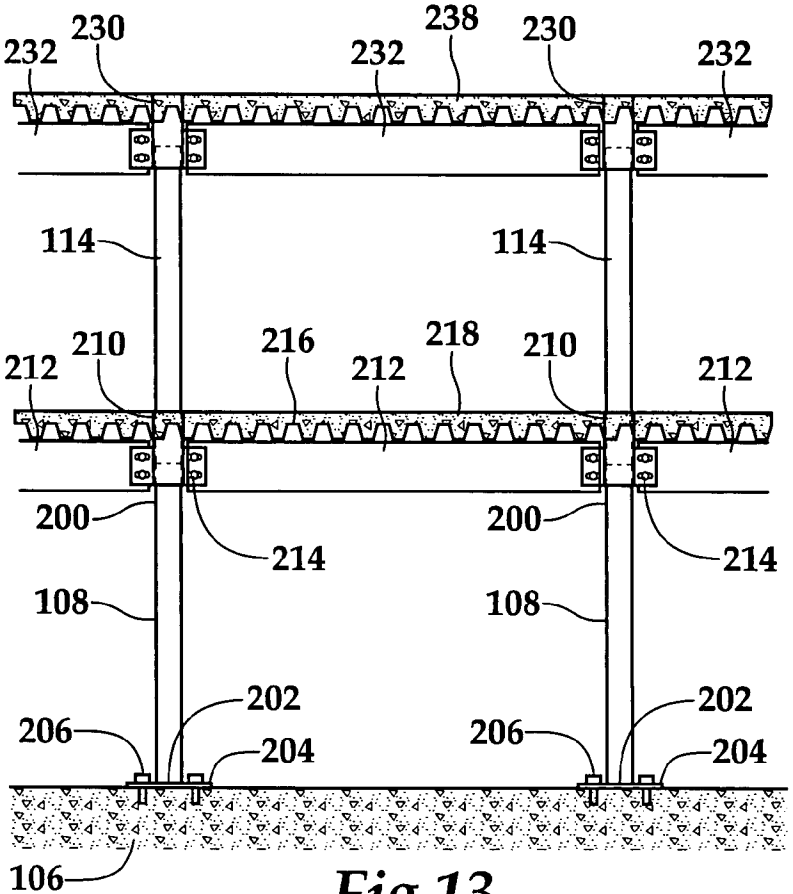
FIG. 13 is a side detail view of a building according to the present invention at an eighth stage of construction.
Figure 12:
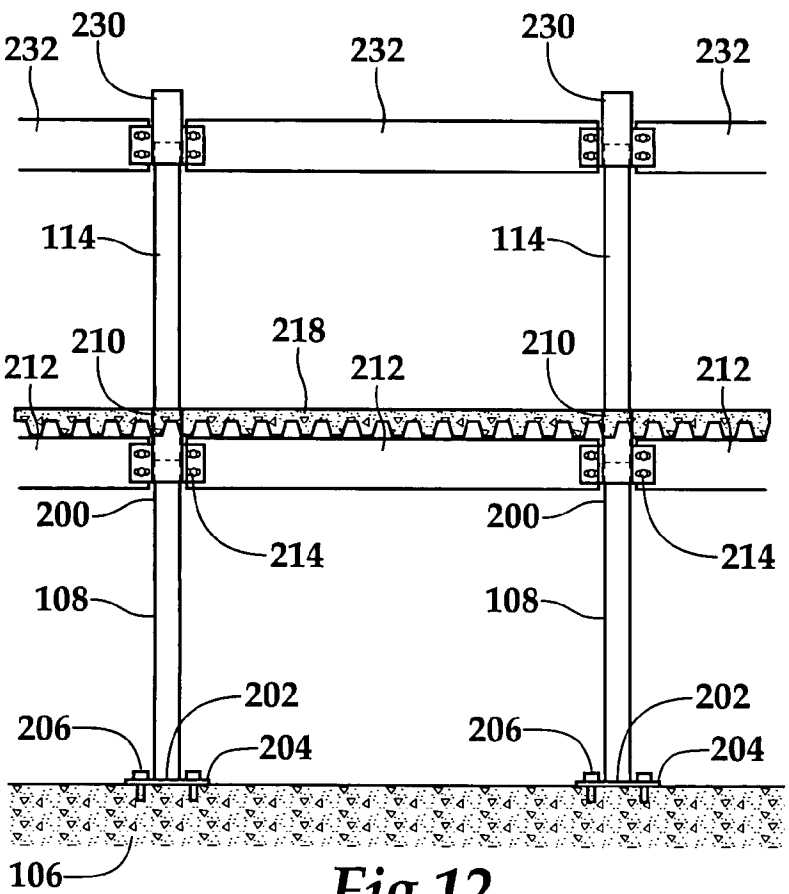
FIG. 12 is a side detail view of a building according to the present invention at a seventh stage of construction.

After placement of the second-floor columns 114, a second set of connectors 230 is then disposed on the free upper ends of second-floor columns 114, and may, as described above, be fastened to second-floor columns 114. After placement of connectors 230, a set of third-floor beams 232 is assembled to connectors 230 by fasteners 234, as shown in FIG. 12. A sheet metal panel 236, similar to sheet metal panel 216, is placed over third-floor beams 232, and a concrete slab 238 is poured and prepared over the top of sheet metal panel 236, level to the tops of connectors 230, in a similar manner to that described above in connection with concrete slab 218. This is shown in FIG. 13.

Figure 15:
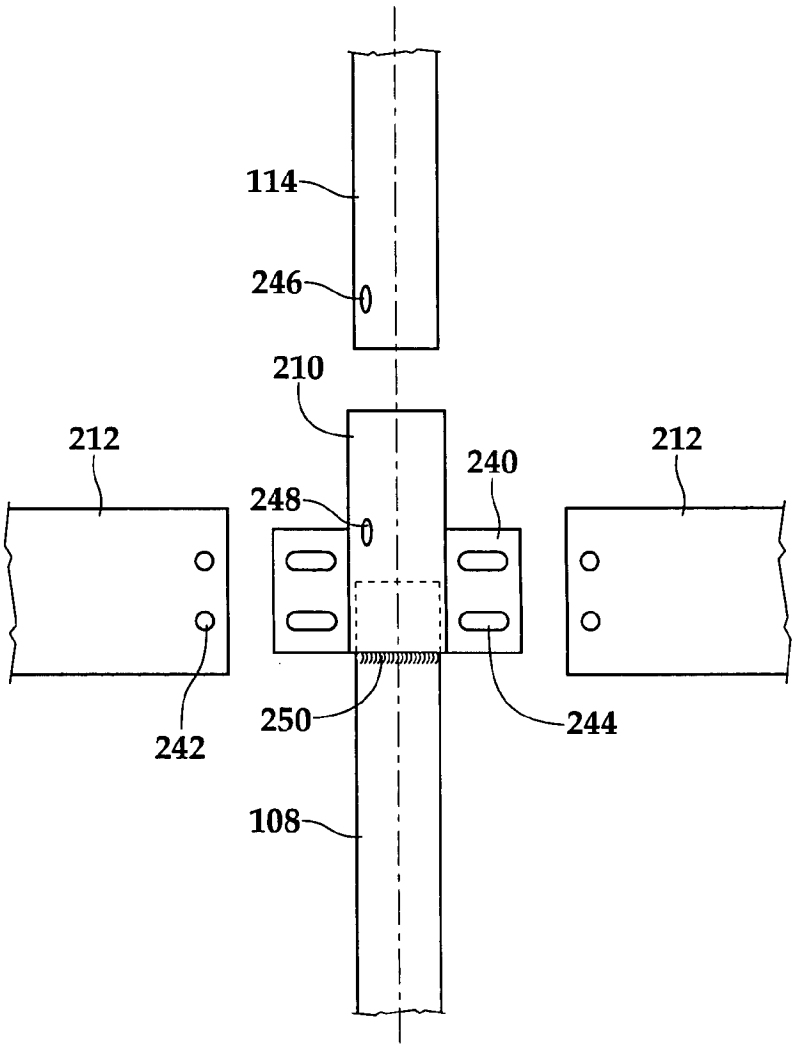
FIG. 15 is a side detail view of a second embodiment of a construction joint suitable for use with the present invention.
Figure 14:
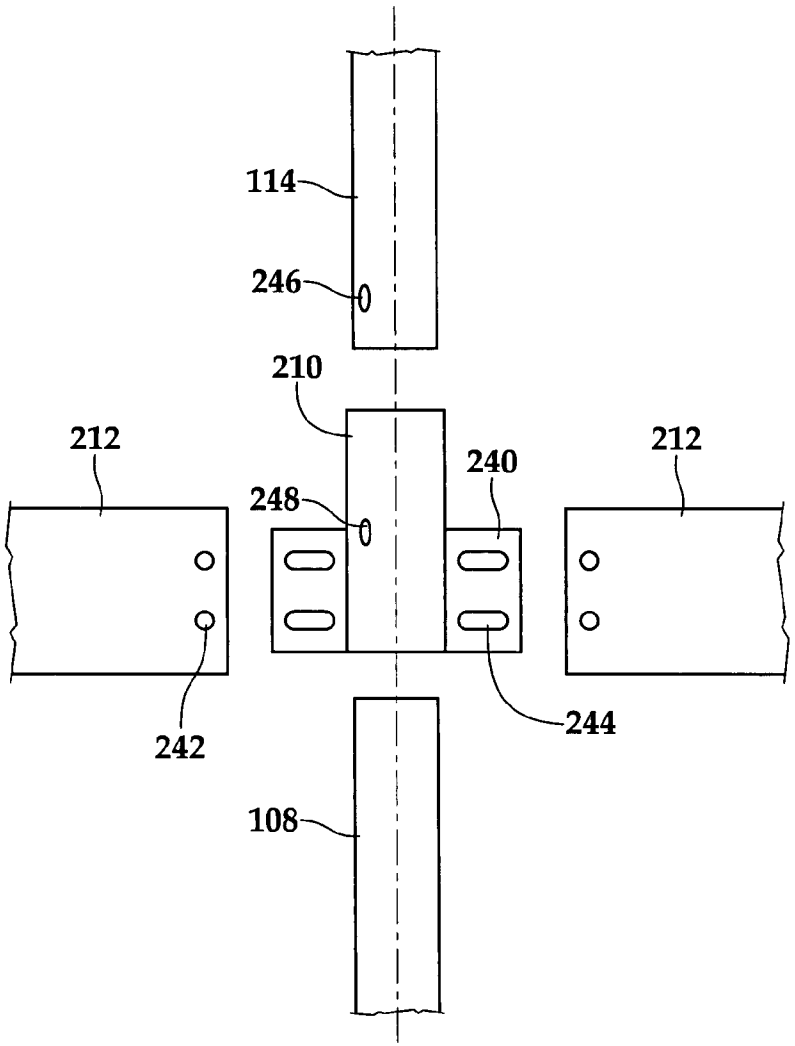
FIG. 14 is a side detail view of the construction joints shown in FIGS. 6–13.

FIGS. 14 and 15 depict two detailed views of the manner of assembly of first floor columns 108, second floor columns 114, and second floor beams 212 using connectors 210. As noted above, after the connector 210 has been placed onto its corresponding first-floor column 108, the second-floor beams 212 are attached to the connector 210. In the embodiment shown in FIGS. 14 and 15, each connector 210 incorporates one or more ears 240, each having one or more attachment features such as slots 244. Slots 244 are positioned to align with corresponding attachment features in the ends of second floor beams 212, such as fastener bores 242 shown. In this embodiment, threaded or driven fasteners are passed through one or more of the slots 244 and their respective corresponding fastener bores 242, so as to secure the assembly.

After assembly of the beams 212 to the connectors 210, the sheet metal panel is put in place and a concrete floor poured, as described above. One or more second floor columns 114 may then be assembled to the connectors 210. In the embodiment shown in FIGS. 14 and 15, the second floor columns 114 are assembled to connectors 210 by sliding the lower ends of the second floor columns 114 into the top portions of connectors 210, although other mating arrangements are possible.

In the embodiment shown in FIGS. 14 and 15, the lower ends of columns 114 include a fastener bore 246, which is positioned to align with a corresponding fastener bore 248 in the body of connector 210 after assembly. A fastener, such as a threaded or driven fastener, may then be disposed through these fastener bores 246 and 248 so as to secure the assembly. Although not shown in FIG. 14, a similar set of fastener bores may be disposed in the lower portion of connector 210, so as to facilitate securement of the connector 210 to the first-floor column 108. In the embodiment shown in FIG. 15, the connector 210 is secured to the upper portion of the first-floor column 108 by a weldment 250, making the use of a fastener unnecessary. The weldment 250 may be created at the job site, or may be created offsite, such as at a factory, so that the first-floor column 108 and the connector 210 would be shipped to the job site having already been secured together.

Figure 16:
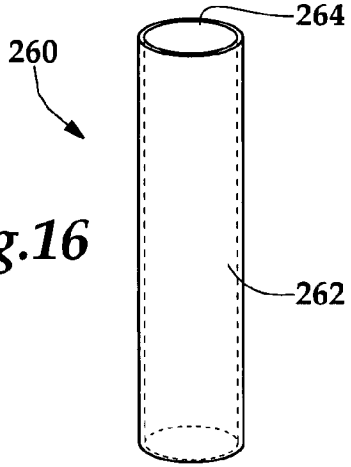
FIG. 16 is a first embodiment of a connector suitable for use with the present invention.

FIGS. 16–19 depict a set of connectors suitable for use with the present invention. In various embodiments, certain of these connectors may be substituted in the place of connector 210 shown above. The cylindrical connector 260 of FIG. 16 is a structurally and geometrically simple connector having a hollow cylindrical body 262 defining an internal cylindrical surface 264. The internal cylindrical surface 264 is designed to receive and position abutting columns such as columns 108 and 114. Although this cylindrical connector 260 could potentially be used with columns having a wide variety of cross-sectional shapes, it would generally be employed in connection with cylindrical columns.

Figure 17:
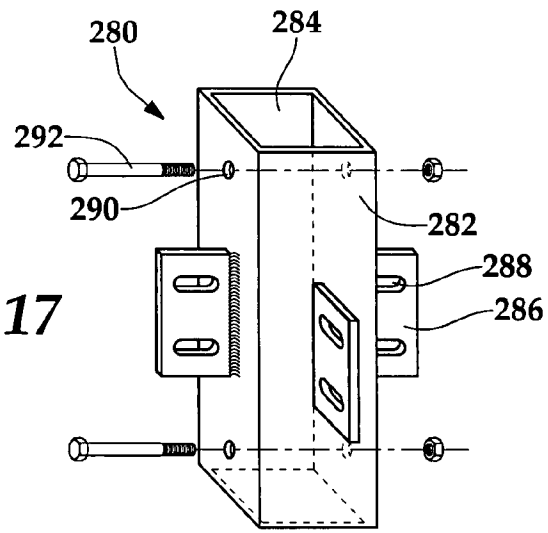
FIG. 17 is a second embodiment of a connector suitable for use with the present invention.

The box-shaped connector 280 of FIG. 17 has a somewhat more complex shape than cylindrical connector 260. Box-shaped connector 280 has an elongated rectangular body 282 having a hollow square cross-section. The internal surface 284 of box-shaped connector 280 defines a square receiving aperture suitable to receive square columns. Box-shaped connector 280 includes a set of ears 286, each having a pair of slots 288 disposed therein for receipt of fasteners, in order to fasten ears 286 to beams such as beams 212 in the manner described above. Box-shaped connector 280 also includes a set of fastener bores 290 to facilitate the use of fasteners such as bolts 292 to secure the assembled joint.

Figure 18:
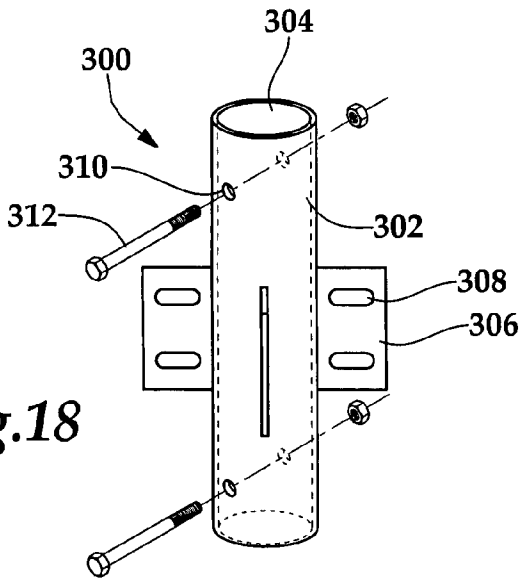
FIG. 18 is a third embodiment of a connector suitable for use with the present invention.

The cylindrical connector 300 of FIG. 18 has a similar arrangement to box-shaped connector 280. Cylindrical connector 300 has an elongated cylindrical body 302 having a hollow circular cross-section. The internal surface 304 of cylindrical connector 300 defines a circular receiving aperture suitable to receive columns of various shapes. Cylindrical connector 300 includes a set of ears 306, each having a pair of slots 308 disposed therein for receipt of fasteners, in order to fasten ears 306 to beams such as beams 212 in the manner described above. Cylindrical connector 300 also includes a set of fastener bores 310 to facilitate the use of fasteners such as bolts 312 to secure the assembled joint.

Figure 19:
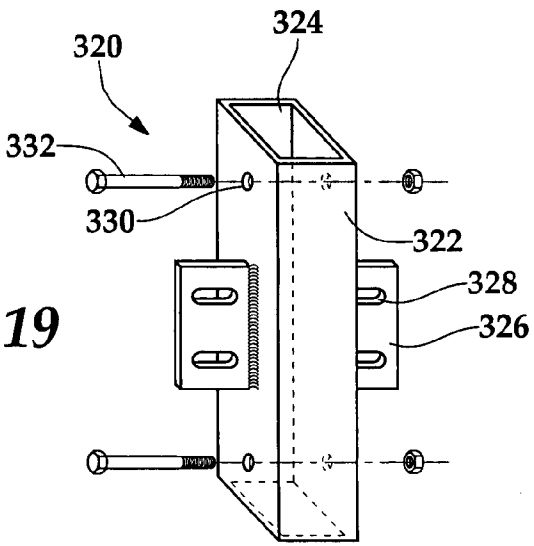
FIG. 19 is a fourth embodiment of a connector suitable for use with the present invention.

The box-shaped connector 320 of FIG. 19 has a similar shape to box-shaped connector 280. Box-shaped connector 320 has an elongated rectangular body 322 having a hollow rectangular cross-section. The internal surface 324 of box-shaped connector 300 defines a rectangular receiving aperture suitable to receive rectangular columns. Box-shaped connector 320 includes a set of ears 326, each having a pair of slots 328 disposed therein for receipt of fasteners, in order to fasten ears 326 to beams such as beams 212 in the manner described above. Box-shaped connector 320 also includes a set of fastener bores 330 to facilitate the use of fasteners such as bolts 332 to secure the assembled joint.

Figure 20:
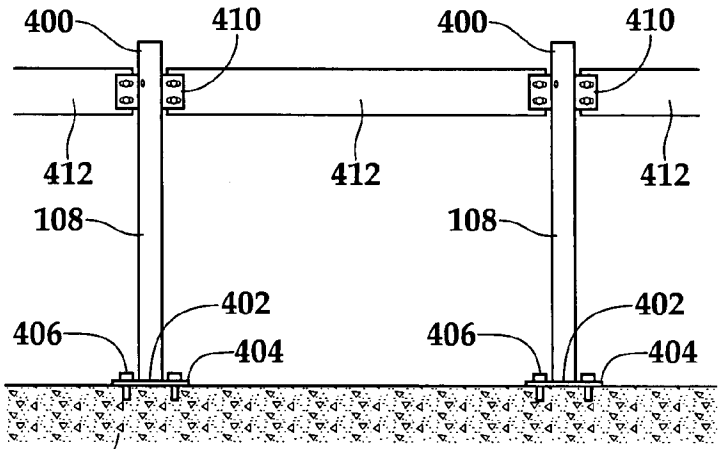
FIG. 20 is a side detail view of a building structure in accordance with certain embodiments of the present invention at a first stage of construction.

FIGS. 20–25 depict a process for construction of a building employing a second embodiment of the structures of the present invention. As seen in FIG. 20, construction begins with the establishment of a foundation 106. One or more first-floor columns 108 are secured to the foundation 106 through a flange or mounting flange 404 attached to the lower portion 402 of the first-floor columns 108. In the embodiment shown in FIG. 20, flange 404 is secured to foundation 106 through fasteners 406, which may be driven or threaded fasteners.

Figure 21:
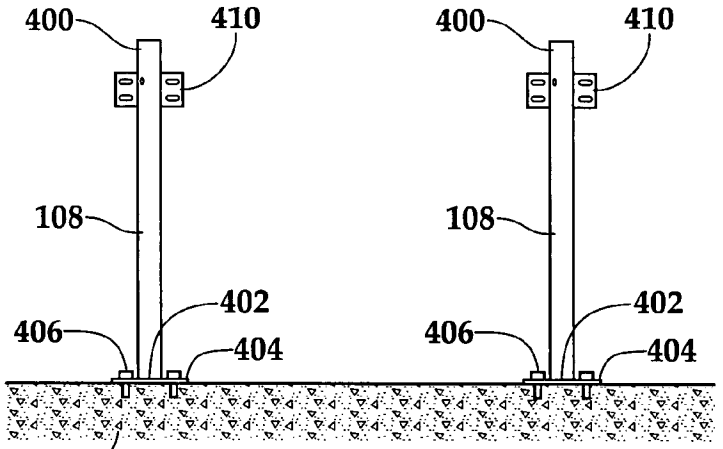
FIG. 21 is a side detail view of the building structure of FIG. 20 at a second stage of construction.
Figure 22:
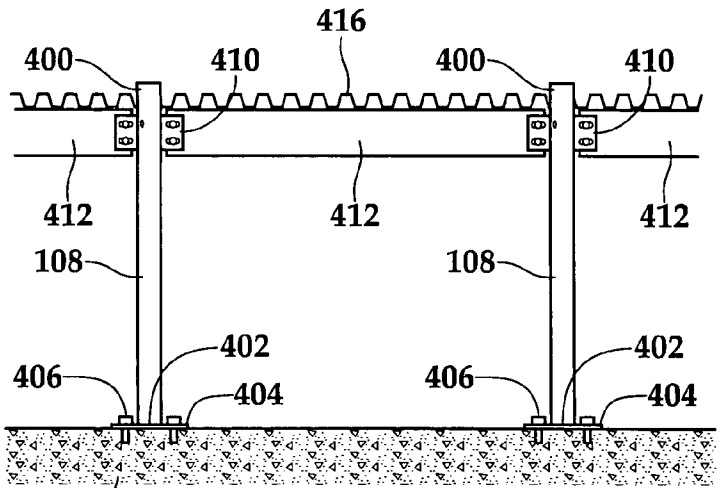
FIG. 22 is a side detail view of the building structure of FIGS. 20–21 at a third stage of construction.

The upper end 400 of each column 108 incorporates one or more mounting ears 410 suitable for securing second-floor beams 412, as shown in FIG. 21. After assembly of the second-floor beams 412 to the mounting ears 410 of first-floor columns 108, a sheet metal panel 416 is placed over the top of the assembly of second-floor beams 412 and mounting ears 410, as shown in FIG. 22. The sheet metal panel 416 has a set of apertures (not shown) spaced appropriately therein so as to allow the tops of the first-floor columns 108 to pass through the sheet metal panel 416 and to allow the bottom of the sheet metal panel 416 to come to rest on the top surfaces of the second-floor beams 412. In certain embodiments, sheet metal panel 416 may be fastened to the second-floor beams 412.

Figure 23:
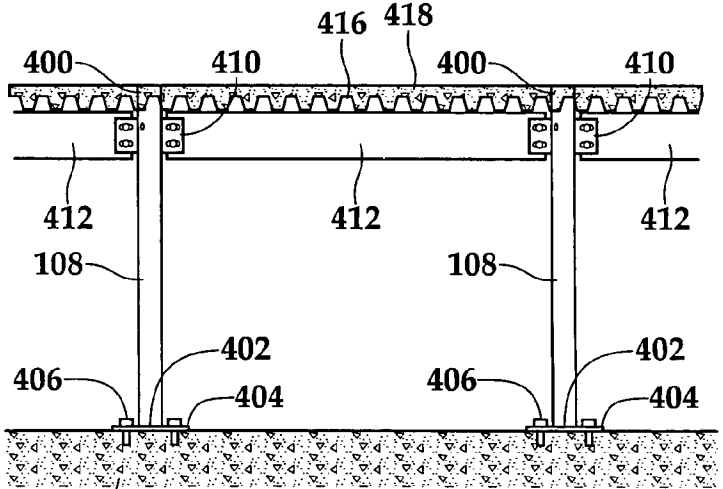
FIG. 23 is a side detail view of a building structure of FIGS. 20–22 at a fourth stage of construction.

After placement of the sheet metal panel 416, a concrete slab 418 is poured on the top of the sheet metal panel 416, thereby forming second floor 112, as shown in FIG. 23. Concrete slab 418 is poured in such manner that the top surface of the concrete slab 418 is aligned to the tops of first-floor columns 108. With this design, the tops of the first-floor columns 108 do not interfere with the pouring and preparation of concrete slab 218, while at the same time the tops of first-floor columns 108 are left open so as to receive and interface with the upper structural members.

Figure 24:
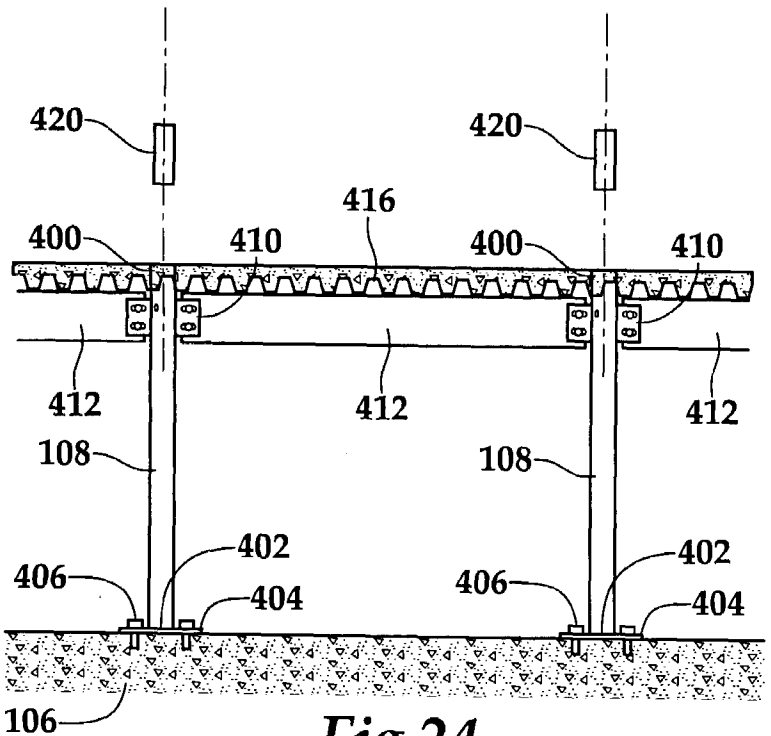
FIG. 24 is a side detail view of a building structure of FIGS. 20–23 at a fifth stage of construction.

After pouring, preparation and curing of concrete slab 418, internal connectors 420 are inserted into the upper ends 400 of first-floor columns 108, as shown in FIG. 24. These internal connectors 420 may be fastened, welded, brazed or adhered into place, as desired. Internal connectors 420 may be sized for an interference fit within first-floor columns 108, or may slide freely.

In general, internal connectors 420 do not bear any weight loading from the upper floors of the building 100. The function of internal connectors 420 is to align each of the second-floor columns 114 to the corresponding first-floor column 108. The vertical weight load is transferred directly from the bottom of the second-floor column 114 to the top of the first-floor column 108 directly beneath it.

Figure 25:
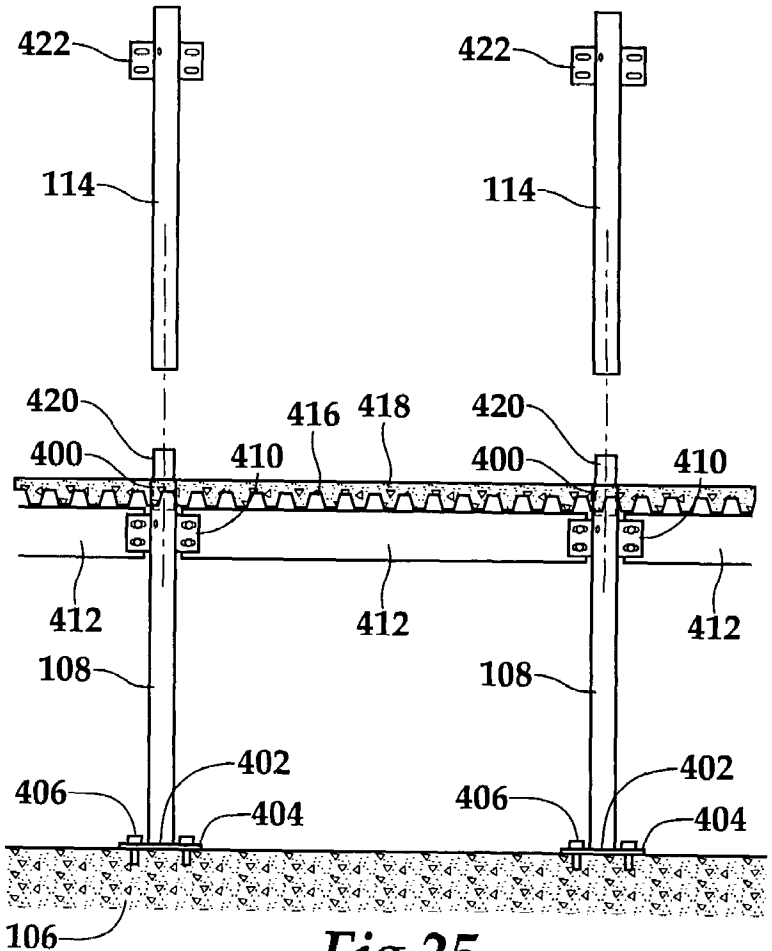
FIG. 25 is a side detail view of a building structure of FIGS. 20–24 at a sixth stage of construction.

After placement of the internal connectors 420, one or more second-floor columns 114 are placed over the top ends of internal connectors 420, as shown in FIG. 25. Second floor columns 114 may be sized to freely slide over internal connectors 420, or may be sized for an interference fit. Similar to first-floor columns 108, second-floor columns 114 incorporate a set of mounting ears 422 attached to the free upper ends of second-floor columns 114. After placement and securement of second-floor columns 114, construction of the third and subsequent floors proceeds in a manner similar to that described above in connection with FIGS. 6–13.

FIGS. 26–29 depict various embodiments of internal connectors suitable for use in the manner described above for internal connector 420. Cylindrical connector 440 shown in FIG. 26 has a simple solid cylindrical shape. Box-shaped connector 450 shown in FIG. 27 has the shape of a hollow elongated box having a square cross-section with transverse fastener apertures 452 shaped and sized to receive fasteners 454.

Figure 29:
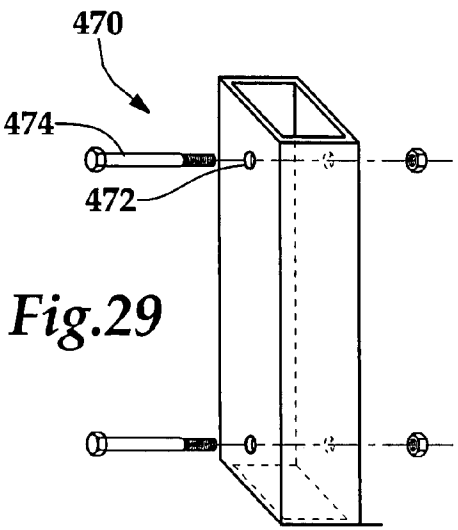
FIG. 29 is a fourth embodiment of an internal connector suitable for use with the present invention.
Figure 26:
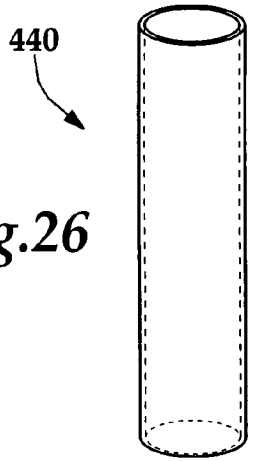
FIG. 26 is a first embodiment of an internal connector suitable for use with the present invention.
Figure 28:
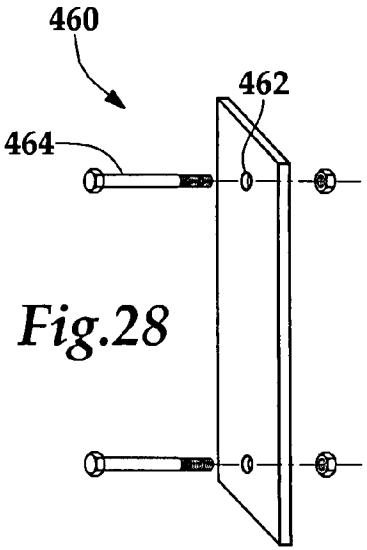
FIG. 28 is a third embodiment of an internal connector suitable for use with the present invention.

FIG. 28 depicts a plate connector 460 having the shape of a rectangular plate with transverse fastener apertures 462 shaped and sized to receive fasteners 464. FIG. 29 depicts a rectangular box-shaped connector 470 having a rectangular cross-section with transverse fastener apertures 472 shaped and sized to receive fasteners 474. Those of skill in the art will appreciate that the shapes of internal connectors 440–470 are provided merely as examples, and that a wide variety of cross-sectional profiles may be employed with success.

Figure 30:
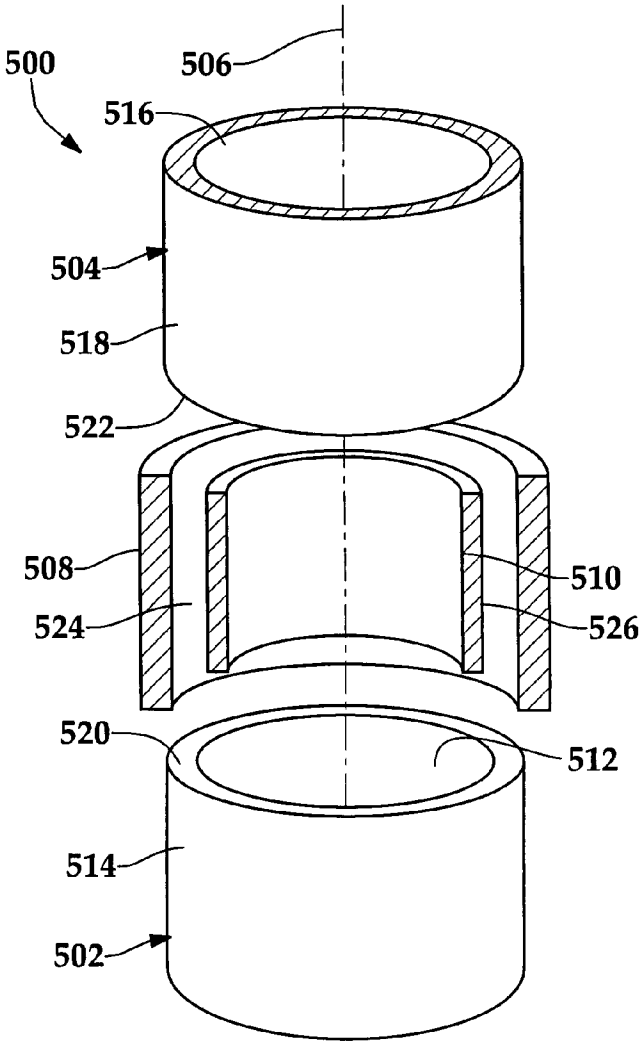
FIG. 30 is a partial section exploded detail view of a column joint assembly in accordance with certain embodiments of the present invention.
Figure 27:
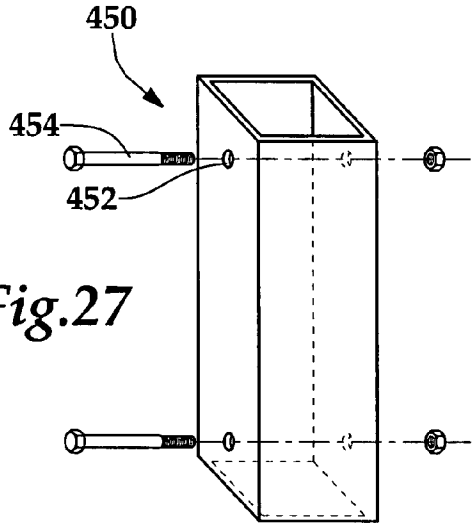
FIG. 27 is a second embodiment of an internal connector suitable for use with the present invention.

FIG. 30 depicts a column joint assembly 500 according to one embodiment of the present invention shown in exploded view for clarity. Column joint assembly 500 includes a lower column upper portion 502 and an upper column lower portion 504 disposed along a common principal axis 506. In the embodiment shown in FIG. 30, column portions 502 and 504 are not self-aligning, so that an additional component is necessary to align the two column portions 502 and 506 to one another. Alternate embodiments may include column portions having inherent alignment features. Column joint assembly 500 employs a pair of connectors 508 and 510 to facilitate alignment of column portions 502 and 504.

Lower column upper portion 502 has a substantially-uniform generally-cylindrical, hollow cross-section along its length, having an internal surface 512, an external surface 514 and an upper surface 520. Upper column lower portion 504 also has a substantially-uniform generally-cylindrical, hollow cross-section along its length, having an internal surface 516, an external surface 518 and a lower surface 522.

Although generally-cylindrical, hollow column portions are shown as examples, a number of cross-sectional profiles can be employed without departing from the spirit and scope of the present invention. These can include square, rectangular, wide flange or I-beam sections, as examples. Further, there is no requirement that the mating column portions 502 and 504 have identical cross-sections. In one embodiment of the present invention, for example, the cross-sectional area of the upper columns is reduced in order to reduce the weight and cost of the upper columns. This can be done by, for example, reducing the sidewall thickness of the columns, reducing the outside dimensions of the columns, or both.

Lower column upper portion 502 and upper column lower portion 504 are aligned to one another by external connector 508 and internal connector 510. Connectors 508 and 510 are shown sectioned along their centerlines solely for viewability. In this embodiment, they have a hollow cylindrical shape similar to that shown for column portions 502 and 504. Generally, only one of the two connectors would be used in a single joint, but two connectors could be used as shown if applications so dictated. It will be appreciated by those of skill in the art that connectors 508 and 510 are presented in the form of relatively simple geometric shapes as examples, but that such connectors may have more complex shapes in many applications, and may include brackets and/or fastener holes, including the type shown in FIGS. 6–29, in order to facilitate attachment to surrounding structural members.

External connector 508 aligns column portions 502 and 504 using its internal surface 524, which registers against external surface 514 of lower column upper portion 502 and external surface 518 of upper column lower portion 504. Similarly, external connector 510 aligns column portions 502 and 504 using its external surface 526, which registers against internal surface 512 of lower column upper portion 502 and internal surface 516 of upper column lower portion 504.

Although the alignment features shown are concentric cylindrical surfaces, it is not necessary that the alignment features be cylindrical, or that they be contiguous surfaces. It is only necessary that the mating features engage in such a manner as to align the lower column upper portion 502 and upper column lower portion 504 to one another.

It should be noted that, in this embodiment, neither internal connector 508 nor external connector 510 supports upper column lower portion 504. The upper column lower portion 504 is supported at is lower surface 522 by lower column upper surface 520. This design has the advantage of placing all or most of the structural portion of the lower column in compression under normal loading conditions. This compressive stress will generally be, in this embodiment, evenly distributed across the cross-sectional area of the lower column. As noted above, while lower column upper surface 520 is shown as a planar surface, a variety of surface profiles are operable in connection with the present invention.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims.

The invention claimed is:

1. A system for constructing a building comprising:

at least one first-floor column having an upper end and a lower end, the lower end having at least one mounting flange attached thereto and the upper end having an internal receiving aperture and one or more mounting ears attached to the outside thereof;

at least one second-floor support beam having features shaped and sized to facilitate securement to at least one mounting ear of the first-floor column;

at least one internal connector having a first portion having an external cross-sectional profile matching the internal receiving aperture of the first-floor column and a second portion having an external cross-sectional profile; and at least one second-floor column having an upper end and a lower end, the lower end having an internal receiving aperture having an internal cross-sectional profile matching the external cross-sectional profile of the second portion of the internal connector, wherein the at least one first-floor column and the at least one second floor column abut each other at cooperating ends.

2. The system of claim 1 wherein the at least one first-floor column and the at least one second-floor column has a circular internal profile.

3. The system of claim 1 wherein the at least one internal connector has a circular external profile along at least a portion of its length.

4. The system of claim 1 wherein the at least one mounting ear is a plate having at least one slot therein.

5. The system of claim 1 wherein the at least one column has the shape of a hollow cylindrical tube.

6. The system of claim 1 wherein the upper end of the at least one first-floor column has a surface profile matching the surface profile of the lower end of the at least one second-floor column.

7. The system of claim 1 wherein additional floors above the second floor are supported by additional columns and additional ones of the support beams and internal connectors.

* * * * *